US009591891B1

(12) United States Patent
Baucom et al.

(10) Patent No.: US 9,591,891 B1
(45) Date of Patent: Mar. 14, 2017

(54) ARTICLE HAVING SOLE ASSEMBLY WITH CLEATS

(71) Applicant: NIKE, Inc., Beaverton, OR (US)

(72) Inventors: Jim Baucom, Portland, OR (US); Jeff Rasmussen, Portland, OR (US); Josh Fedderly, Portland, OR (US); Darlan Zacharia, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 14/961,478

(22) Filed: Dec. 7, 2015

(51) Int. Cl.

| | |
|---|---|
| ***A43B 5/00*** | (2006.01) |
| ***A43C 15/16*** | (2006.01) |
| ***A43B 13/14*** | (2006.01) |
| ***A43B 13/42*** | (2006.01) |
| ***A43B 5/02*** | (2006.01) |
| ***A43B 5/06*** | (2006.01) |

(52) U.S. Cl.
CPC ..... *A43C 15/16* (2013.01); *A43B 5/002* (2013.01); *A43B 5/02* (2013.01); *A43B 5/06* (2013.01); *A43B 13/14* (2013.01); *A43B 13/42* (2013.01)

(58) Field of Classification Search
CPC ..... A43B 5/02; A43C 15/16
USPC ..... 36/67 R, 134, 126, 127, 128, 129
See application file for complete search history.

(56) References Cited

U.S. PATENT DOCUMENTS 4,663,865 A 5/1987 Telecemian
4,782,604 A * 11/1988 Wen-Shown ..... A43B 5/001 36/127
4,837,949 A * 6/1989 Dufour ..... A43B 13/188 36/114
6,023,861 A 2/2000 Bizzotto
6,145,221 A 11/2000 Hockerson
6,935,055 B2 8/2005 Oorei
6,954,998 B1 10/2005 Lussier
6,973,746 B2 * 12/2005 Auger ..... A43B 1/0072 36/128
7,143,530 B2 * 12/2006 Hudson ..... A43B 1/0072 36/128
7,487,604 B2 2/2009 Perron, Jr.
7,832,117 B2 11/2010 Auger et al.
8,713,819 B2 * 5/2014 Auger ..... A43B 5/02 36/102

(Continued)

FOREIGN PATENT DOCUMENTS

EP 0723745 A1 7/1996

*Primary Examiner* — Marie Bays
(74) *Attorney, Agent, or Firm* — Honigman Miller Schwartz and Cohn LLP; Matthew H. Szalach; Jonathan P. O'Brien

(57) ABSTRACT

An article of footwear has a sole assembly that is further comprised of a chassis, a reinforcing member and a forefoot plate. The reinforcing member includes lateral and medial forefoot portions that fit with corresponding recesses in the forefoot plate and the reinforcing member in the forefoot region of the chassis. The reinforcing member includes a central portion that figs with a corresponding recess in the heel region of the chassis. The chassis and the forefoot plate include ridges on their outer surfaces. Cleats extending from ridges in the forefoot of the chassis are vertically aligned with protrusions on ridges in the forefoot plate. The protrusions can help diffuse forces applied by the cleats against the inner components of the sole and foot to reduce point loading.

27 Claims, 15 Drawing Sheets

(56) References Cited

U.S. PATENT DOCUMENTS

| | | | | |
|---|---|---|---|---|
| 8,782,928 | B2 * | 7/2014 | Amos | A43B 13/141 36/102 |
| 9,113,676 | B2 | 8/2015 | Campbell et al. | |
| 2003/0029060 | A1 | 2/2003 | Hockerson et al. | |
| 2005/0016029 | A1 * | 1/2005 | Auger | A43B 1/0072 36/134 |
| 2006/0064905 | A1 * | 3/2006 | Hudson | A43B 1/0072 36/128 |
| 2010/0126044 | A1 | 5/2010 | Davis | |
| 2012/0180343 | A1 * | 7/2012 | Auger | A43B 5/02 36/30 R |
| 2013/0067765 | A1 * | 3/2013 | Auger | A43B 5/02 36/31 |
| 2013/0139412 | A1 * | 6/2013 | Auger | A43B 1/0009 36/25 R |
| 2013/0340295 | A1 | 12/2013 | Adami et al. | |
| 2014/0338230 | A1 * | 11/2014 | Auger | A43B 5/02 36/30 R |
| 2014/0366402 | A1 | 12/2014 | Cavaliere et al. | |
| 2016/0007677 | A1 * | 1/2016 | Auger | A43B 1/0009 36/30 R |
| 2016/0242499 | A1 * | 8/2016 | Droege | A43B 13/026 |
| 2016/0255912 | A1 * | 9/2016 | Auger | A43B 3/0052 |

* cited by examiner

ARTICLE HAVING SOLE ASSEMBLY WITH CLEATS

BACKGROUND

The present embodiments relate generally to articles of footwear, and in particular to articles of footwear with cleats.

Articles of footwear generally include two primary elements: an upper and a sole structure. The upper may be formed from a variety of materials that are stitched or adhesively bonded together to form a void within the footwear for comfortably and securely receiving a foot. The sole structure is secured to a lower portion of the upper and is generally positioned between the foot and the ground. In many articles of footwear, including athletic footwear styles, the sole structure often incorporates an insole, a midsole, and an outsole.

The sole structure may also incorporate one or more cleats. Cleats may be ground penetrating structures as well as other structures that facilitate traction and grip with a ground surface.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

The embodiments disclose a sole assembly for an article of footwear that is comprised of several different components: a chassis, a reinforcing member and a forefoot plate. In one embodiment, the chassis is full length and includes ridges on an outer surface as well as recesses on an inner surface to receive corresponding ridges of the forefoot plate as well as portions of the reinforcing member. In one embodiment, the forefoot plate may be a carbon fiber composite plate. The forefoot plate may also include ridges that match the corresponding recesses of the chassis as well as recesses to receive portions of the reinforcing member. The ridges of the chassis form a Y-shaped arrangement along the length of the chassis and the reinforcing member has a similar Y-shaped configuration.

In one embodiment, a lateral and medial forefoot ridge of the chassis extend from an anterior end of the chassis and through the forefoot. The forefoot ridges merge together in the midfoot into a single central ridge that extends from the midfoot and through the heel towards a posterior end of the chassis. The ridges of the forefoot plate likewise run through the length of the forefoot plate and also merge together at a posterior end of the forefoot plate and in a location of the sole assembly that corresponds with where the lateral and medial forefoot ridges of the chassis also merge together.

In one embodiment, the reinforcing member can include one or more ribs to control stiffness and strength. The reinforcing member may include different patterns or arrangements of ribs in different portions. Lateral and medial forefoot portions can include straight ribs extending in diagonal patterns between peripheral edges of each portion and one or more central ribs of each portion. A central portion of the reinforcing member located in the heel may include curved ribs that extend between a peripheral edge of the central portion and a single longitudinal rib extending through the center of the central portion.

Figure 1:
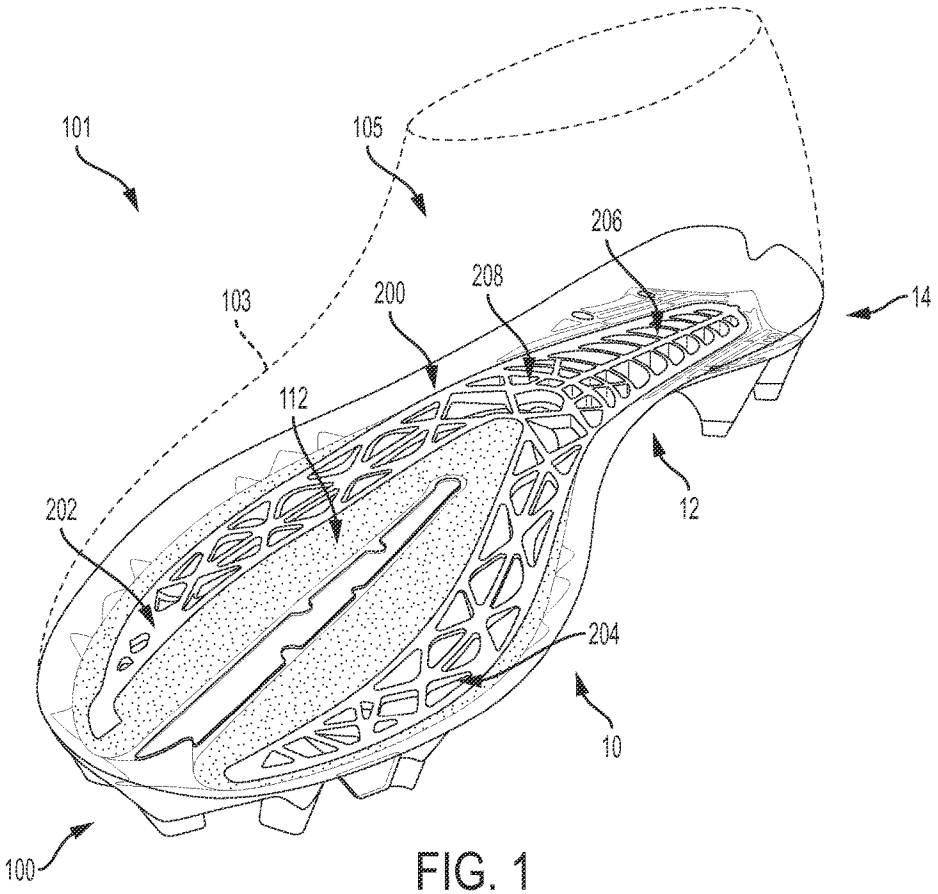
FIG. 1 is a schematic view of an embodiment of an article of footwear with a sole assembly.

FIG. 1 is a schematic view of an embodiment of an article of footwear 101. Article of footwear 101 includes an upper 103 and a sole assembly 100, also referred to simply as assembly 100. Upper 103 is depicted for purposes of reference, and it may be appreciated that in different embodiments the construction and style of upper 103 could vary in any manner. Article 101 may further include an inner void 105 that is formed within upper 103 and/or between upper 103 and sole assembly 100.

For purposes of illustration the exemplary embodiment depicts assembly 100 having a particular type and style that may be used in a cleated American football shoe. However, it may be understood that the sole assembly and the associated features described herein could be incorporated into a wide variety of different article types, each having various possible styles (or designs). That is, in other embodiments, the principles discussed herein could be employed in soles used in any kind of article of footwear using cleats or other kinds of traction elements, including, but not limited to: hiking boots, soccer shoes, football shoes, running cleats, rugby shoes, baseball shoes as well as other kinds of shoes.

For purposes of clarity, the embodiment depicts a single sole assembly for use in a right-oriented article of footwear. However, it will be understood that other embodiments may incorporate a corresponding sole assembly for use in a corresponding article of footwear (e.g., a corresponding left or right shoe in a pair) that may share some, and possibly all, of the features of the various sole assemblies described herein and shown in the figures.

The embodiments may be characterized by various directional adjectives and reference portions. These directions and reference portions may facilitate in describing the portions of a sole assembly and/or more generally any of the individual components of the sole assembly. The term "longitudinal" as used throughout this detailed description and in the claims refers to a direction oriented along a length of a component (e.g., a sole assembly, a chassis, a forefoot plate, a reinforcing member, etc.). In some cases, a longitudinal direction may be parallel to a longitudinal axis that extends between a forefoot portion and a heel portion of the component. Also, the term "lateral" as used throughout this detailed description and in the claims refers to a direction oriented along a width of a component. In some cases, a lateral direction may be parallel to a lateral axis that extends between a medial side and a lateral side of a component. Furthermore, the term "vertical" as used throughout this detailed description and in the claims refers to a direction generally perpendicular to a lateral and longitudinal direction. For example, in cases where an article is planted flat on a ground surface, a vertical direction may extend from the ground surface upward.

Additionally, the term "inner" refers to a portion of a component disposed closer to an interior (or inner void) of an article, or closer to a foot when the article is worn. Likewise, the term "outer" refers to a portion of a component disposed further from the interior (or inner void) of the article or from the foot. Thus, for example, the inner surface of a component is disposed closer to an interior of the article than the outer surface of the component.

The description further makes use of anterior and posterior. As used herein, the term "anterior" refers to a portion closer to the front of a component, while the term "posterior" refers to a portion closer to the rearward end of a component. In a sole assembly, an anterior portion (e.g., an anterior end or edge) may be disposed proximate the toe-box in the very front of the article of footwear. Likewise, in a sole assembly, a posterior portion may be proximate the heel of the article of footwear. This detailed description makes use of these directional adjectives in describing an article and various components of a sole system.

A sole assembly, as well as a sub-component of the sole assembly such as a chassis, reinforcing member and/or plate, may be broadly characterized by a number of different regions or portions. For example, a sole assembly could include a forefoot region, a midfoot region, and a heel region. A forefoot region may be generally associated with the toes and joints connecting the metatarsals with the phalanges in the foot. A midfoot region may be generally associated with the arch of a foot. Likewise, a heel region may be generally associated with the heel of a foot, including the calcaneus bone. In addition, a sole assembly may include a lateral side and a medial side. In particular, the lateral side and the medial side may be opposing sides of a sole assembly. As used herein, the terms forefoot region, midfoot region, and heel region as well as the lateral side and medial side are not intended to demarcate precise areas of a sole system (or more broadly, of an article). Rather, these regions and sides are intended to represent general areas of the sole assembly that provide a frame of reference during the following discussion.

Generally, a sole assembly may be configured to provide various functional properties for an article, including, but not limited to, providing traction/grip with a ground surface as well as attenuating ground reaction forces when compressed between the foot and the ground during walking, running, or other ambulatory activities (e.g., providing cushioning). The configuration of a sole assembly may vary significantly in different embodiments to include a variety of conventional or non-conventional structures. In some cases, the configuration of a sole assembly can be configured according to one or more types of ground surfaces on which the sole assembly may be used. Examples of ground surfaces include, but are not limited to, natural turf, synthetic turf, dirt, hardwood flooring, as well as other surfaces.

Figure 2:
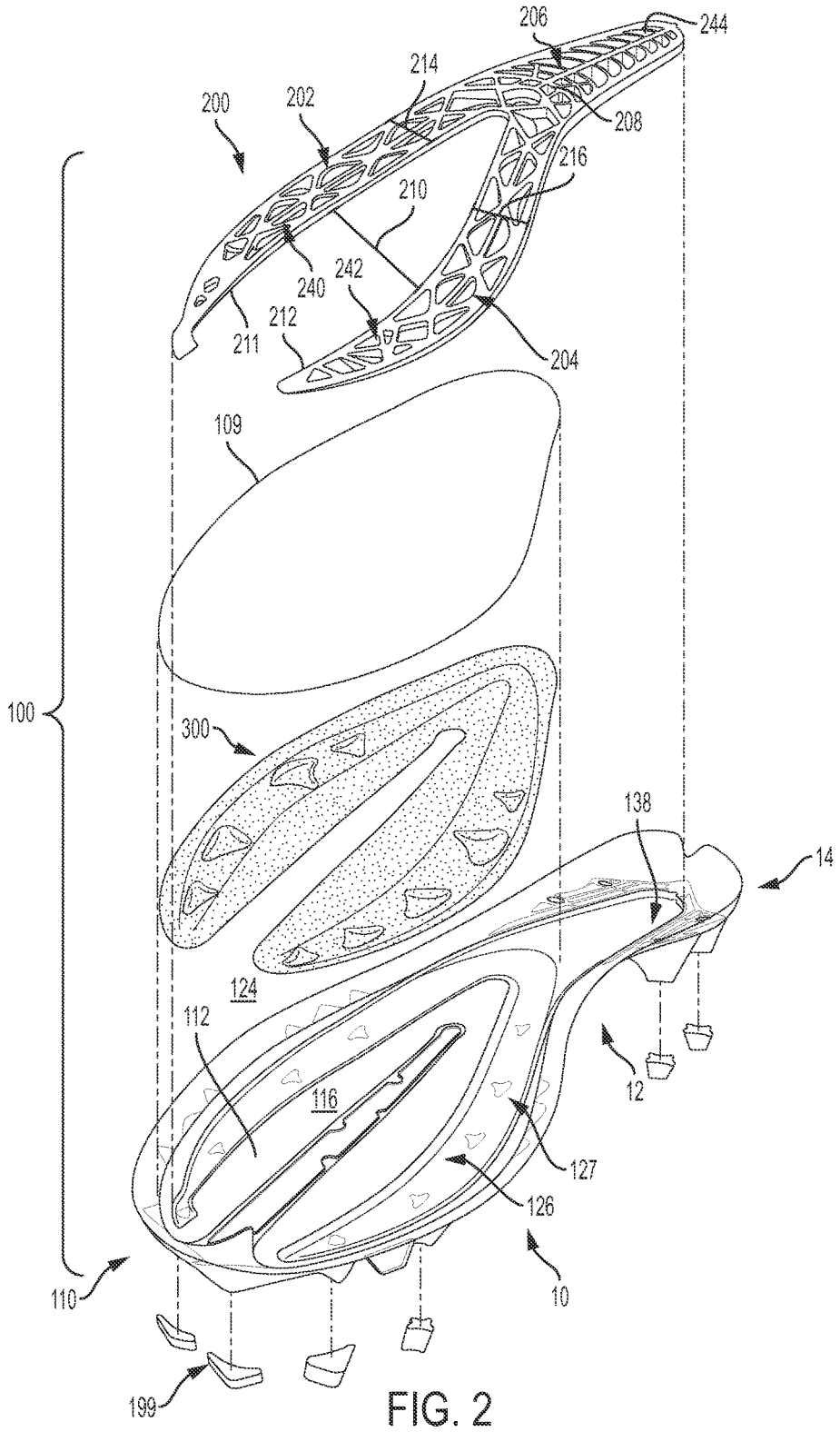
FIG. 2 is a schematic exploded view of the sole assembly shown in FIG. 1.

FIG. 2 illustrates a schematic exploded view of an embodiment of sole assembly 100. Referring to FIGS. 1-2, sole assembly 100 is further comprised of a chassis 110, a reinforcing member 200 and a forefoot plate 300. In some embodiments, these components are formed separately and assembled together during a manufacturing process. As discussed in further detail below, each component may be associated with distinct structural and/or material properties. These structures may be combined within sole assembly 100 to provide enhanced strength, stiffness, traction, comfort and/or energy return for an article including sole assembly 100. For example, forefoot plate 300 may be attached to chassis 110. In some embodiments, forefoot plate 300 may be embedded between an outer surface and an inner surface of chassis 110. For purposes of illustration, therefore, an outer surface portion 109 of chassis 110 has been removed in FIG. 2 to show the location of forefoot plate 300 relative to the inner and outer surfaces of chassis 110. It may be understood that outer surface portion 109 is not generally a separable component or layer of chassis 110 and is only 'exploded away' in FIG. 2 for purposes of clarity. Embedding forefoot plate 300 in chassis 110 may help improve bonding with other components on an inner side of sole assembly 100, since chassis 110 may more readily bond with other materials compared to forefoot plate 300, especially in embodiments where forefoot plate 300 is made of reinforced composite materials (e.g., a carbon-fiber plate). In contrast to forefoot plate 300, reinforcing member 200 may be disposed directly against (or on top of) an inner surface of chassis 110, rather than being fully or partially embedded in chassis 110. In other embodiments, reinforcing member 200 could be fully or partially embedded in chassis 110.

Figure 3:
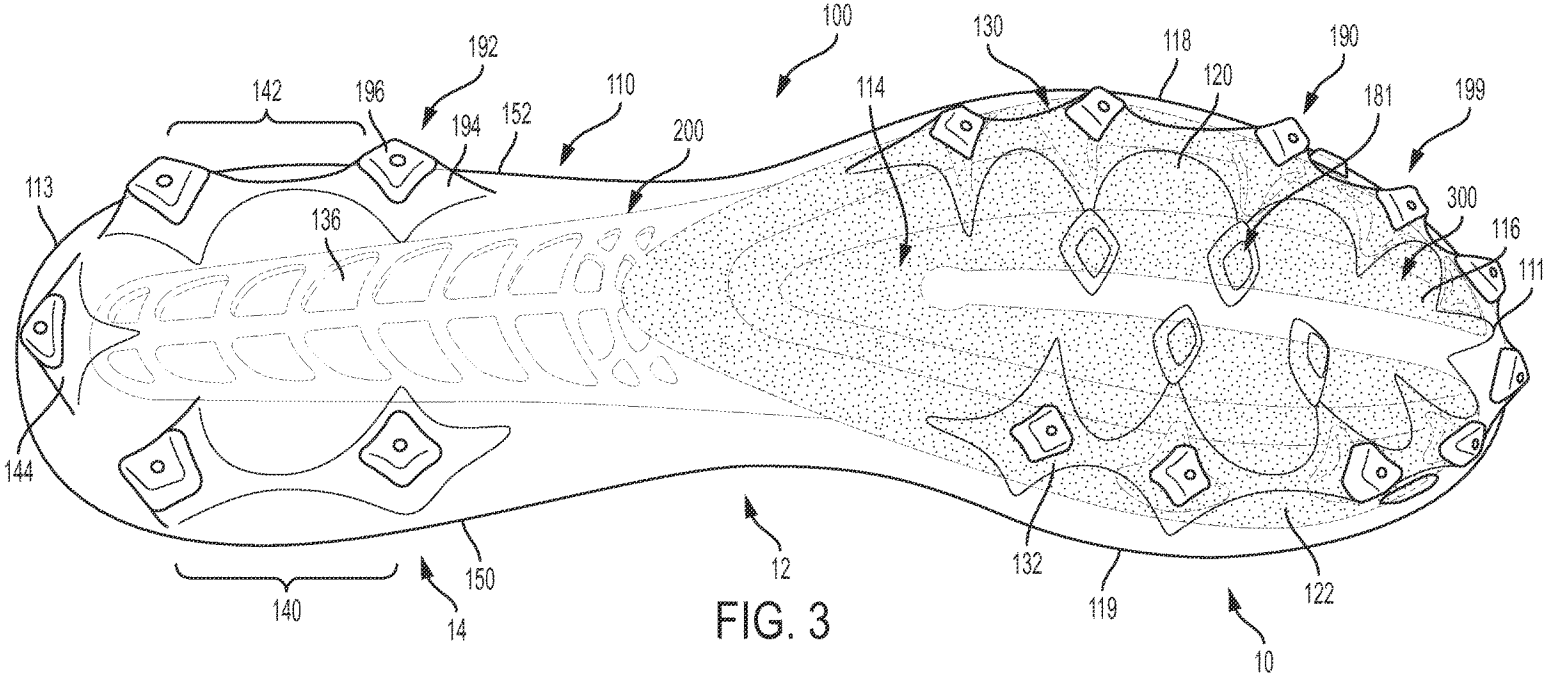
FIG. 3 is a schematic bottom view of the sole assembly shown in FIG. 1.

FIG. 3 is a schematic bottom view of an embodiment of assembly 100. As seen in FIG. 3, assembly 100 includes a plurality of cleats 190 that are disposed on a bottom side of assembly 100. As used herein, the term 'cleat' refers to a structure that engages with a ground surface and that may further penetrate some kinds of ground surfaces, such as grass or dirt. Each cleat of plurality of cleats 190 may be further comprised of distinct components of sole assembly 100, and may not be monolithic structures. In the embodiment shown in FIG. 3, for example, an exemplary cleat 192 (in heel region 14) is comprised of a protrusion 194 (or projection) extending away from an outer surface of chassis 110 and a cleat tip 196 that is bonded with, or otherwise attached to, protrusion 194. Each of the remaining cleats in plurality of cleats 190 are seen to be constructed similarly, with each comprising a projection of chassis 110 at its base and a cleat tip disposed at its distal-most (i.e., outer-most) end.

Referring now to FIGS. 1-3, chassis 110 may be a full-length component, including forefoot region 10, midfoot region 12 and heel region 14. Moreover, chassis 110 may provide an outer structure for assembly 100, within which forefoot plate 300 and reinforcing member 200 may be housed or contained. Optionally, in other embodiments, a chassis could be partial-length and could lack a forefoot region, midfoot region and/or heel region.

Referring to FIGS. 2 and 3, chassis 110 may include an inner surface 112 and an outer surface 114. Inner surface 112 may be disposed closer to inner void 105 of article 101 (see FIG. 1) than outer surface 114. Chassis 110 may also include a base 116 that extends approximately in the longitudinal and lateral directions of sole assembly 100. Base 116 may be generally sized and shaped to support the full length and width of a foot.

Some embodiments of a chassis may include one or more ridges that may increase stiffness in one or more regions of the chassis. The ridges may also include recesses to receive corresponding ridges in adjacent structures. Generally, a ridge may protrude or extend from a base of a chassis. In some embodiments, a ridge may be hollow and may thereby provide a recess on one side, or surface, of the chassis. In other embodiments, a ridge could be solid, or 'filled in', and may not be associated with any corresponding recesses. Ridges may furthermore be located in any regions of a chassis, including the forefoot region, midfoot region and/or heel region. Still further, ridges could be configured in different orientations in different embodiments, including longitudinal orientations, lateral orientations or any orientation along an axis at an angle to the longitudinal and lateral orientations. It may be appreciated that the indicated orientations of a ridge may only be approximate, as the ridges may curve or turn in their extent through the chassis and need not follow a single linear axis.

As seen in FIG. 3, chassis 110 includes a lateral forefoot ridge 120 protruding from base 116 on outer surface 114 of chassis 110. Lateral forefoot ridge 120 extends longitudinally through forefoot region 10 and proximate a lateral edge 118 of the chassis 110. In addition, chassis includes a medial forefoot ridge 122 protruding from base 116 on outer surface 114 of chassis 110. Medial forefoot ridge 122 extends longitudinally through forefoot region 10 of chassis 110 and proximate a medial edge 119 of chassis 110. Furthermore, in the exemplary embodiment of FIGS. 2-3, both lateral forefoot ridge 120 and medial forefoot ridge 122 extend to anterior edge 111 of chassis 110. Although it may be difficult to perceive in the bottom view perspective of FIG. 3, both lateral forefoot ridge 120 and medial forefoot ridge 122 form convex structures on outer surface 114. This geometry may also be clearly seen in FIGS. 6-7.

Each forefoot ridge is convex on outer surface 114 and concave on inner surface 112. Thus, each ridge provides a corresponding recess for chassis 110 on inner surface 112. As best seen in FIG. 2, lateral forefoot ridge 120 forms a lateral forefoot recess 124 on inner surface 112 and medial forefoot ridge 122 forms a medial forefoot recess on 126 inner surface 112. In the exemplary embodiment, each ridge further has a generally rounded cross-sectional shape (see FIG. 7). In particular, both lateral forefoot ridge 120 and medial forefoot ridge 122 may be characterized as having a hollow ridge or channel cross-sectional geometry. The cross-sectional geometry may further be rounded without any sharp corners.

In some embodiments, both a lateral forefoot ridge and a medial forefoot ridge may include one or more cleat structures. For example, as best shown in FIG. 3, lateral forefoot ridge 120 includes a plurality of lateral cleat protrusions 130 that extend, or protrude, from lateral forefoot ridge 120 on outer surface 114 of chassis 110. Similarly, medial forefoot ridge 122 includes a plurality of medial cleat protrusions 132 that extend, or protrude, from medial forefoot ridge 122 on outer surface 114 of chassis 110. These cleat protrusions are further attached to plurality of cleat tips 199 that are shown as exploded away from chassis 110 in FIG. 2. In at least some embodiments, the cleat protrusions on chassis 110 may include a corresponding recess or hole on inner surface 112 that may be filled by corresponding protrusions on a forefoot plate. In FIG. 2, such corresponding recesses on an inner surface of lateral cleat protrusions 130 and medial cleat protrusions 132 are indicated as protrusion recesses 127.

Embodiments of a chassis may also include one or more ridges in the midfoot and/or heel regions of the chassis. In some embodiments, a lateral forefoot ridge and/or a medial forefoot ridge may be continuous with a ridge extending through the midfoot and/or heel regions. In at least some embodiments, a lateral forefoot ridge and a medial forefoot ridge can merge together and form a single ridge extending through the midfoot and heel regions. Alternatively, in other embodiments, a lateral and/or medial forefoot ridge could be spaced apart (i.e., discontinuous) with any ridge(s) in the midfoot and/or heel regions.

Referring to FIG. 3, lateral forefoot ridge 120 and medial forefoot ridge 122 merge into a single central ridge 136 in midfoot region 12 of chassis 110. Central ridge 136 extends from midfoot region 12 into heel region 14. In the embodiment shown in FIG. 3, central ridge 136 extends to a posterior edge 113 of chassis 110. Central ridge 136 further forms a central recess 138 on inner surface 112, as best seen in FIG. 2. In the exemplary embodiment, central ridge also has a generally rounded cross-sectional shape (see FIGS. 8-9). In particular, central ridge 136 may be characterized as having a hollow ridge or channel cross-sectional geometry. The cross-sectional geometry may further be rounded without any sharp corners.

Thus, it may be seen from FIG. 3 that lateral forefoot ridge 120, medial forefoot ridge 122 and central ridge 136 form a continuous Y-shaped raised structure on outer surface 114 of chassis 110, as well as a continuous Y-shaped recess on inner surface 112 of chassis 110. This configuration may provide for enhanced stiffness in heel region 14 as well as enhanced stiffness on in forefoot region 10 adjacent the lateral and medial edges of chassis 110.

Central ridge 136 may also be associated with (i.e., disposed adjacent or directly beneath) one or more cleat structures. Referring to FIG. 3, heel region 14 of chassis 110 may include a first set of heel cleat protrusions 140 on a medial edge 150 of heel region 14 as well as a second set of heel cleat protrusions 142 on a lateral edge 152 of heel region 14. Some embodiments can further include at least one cleat at posterior edge 113 (e.g., cleat protrusion 144 in FIG. 3). Central ridge 136 is seen to pass between first set of heel cleat protrusions 140 and second set of heel cleat protrusions 142. Thus, in contrast to the configuration in the forefoot, where the cleats may be supported on lateral and medial ridges of the chassis, in the heel region the cleats are supported directly by base 116 of chassis 110, rather than central ridge 136.

Referring to FIGS. 1-3, reinforcing member 200 comprises a reinforcing structure that may be fit, or mated, with the inner surface of chassis 110 and/or with the inner surface of forefoot plate 300. To this end, reinforcing member 200 includes several portions with distinct geometries for fitting with the recesses of other components of sole assembly 100. These include a lateral forefoot portion 202, a medial forefoot portion 204 and a central portion 206. As seen in the figures, lateral forefoot portion 202 and medial forefoot portion 204 may merge or join with central portion 206 at a common juncture 208. Together, these portions form a Y-like geometry for reinforcing member 200.

Reinforcing member 200 is sized and shaped to fit in the recesses of chassis 110 (and optionally those of forefoot plate 300, as discussed later). In particular, lateral forefoot portion 202 fills lateral forefoot recess 124 of chassis 110, while medial forefoot portion 204 fills medial forefoot recess 126 of chassis 110. Similarly, central portion 206 forms central recess 138 of chassis 110. This arrangement allows reinforcing member 200 to fill and reinforce chassis 110 through forefoot region 10, midfoot region 12 and heel region 14.

The lateral and medial forefoot portions of a reinforcing member may be spaced apart so as to provide significant reinforcement near the lateral and medial edges of a chassis. In FIG. 2 it is clear that lateral forefoot portion 202 and medial forefoot portion 204 are separated by a distance that is large relative to their respective widths. Specifically, a distance 210 between an interior edge 211 of lateral forefoot portion 202 and an interior edge 212 of medial forefoot portion 204 is greater than a widest portion 214 of lateral forefoot portion 202 and is also greater than a widest portion 216 of medial forefoot portion 204.

Figure 7:
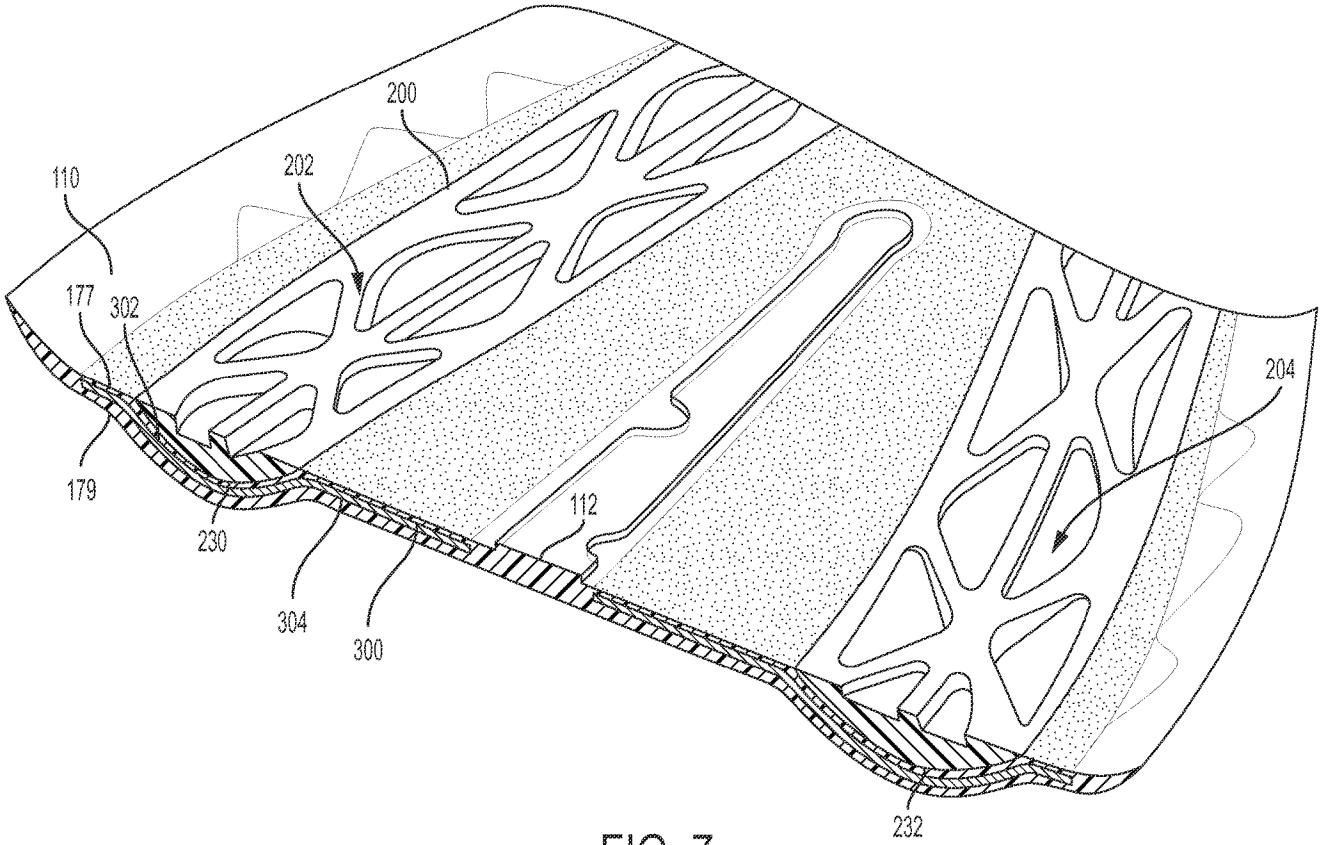
FIG. 7 is a schematic cut-away view taken along a forefoot region of the sole assembly of FIG. 6.
Figure 8:
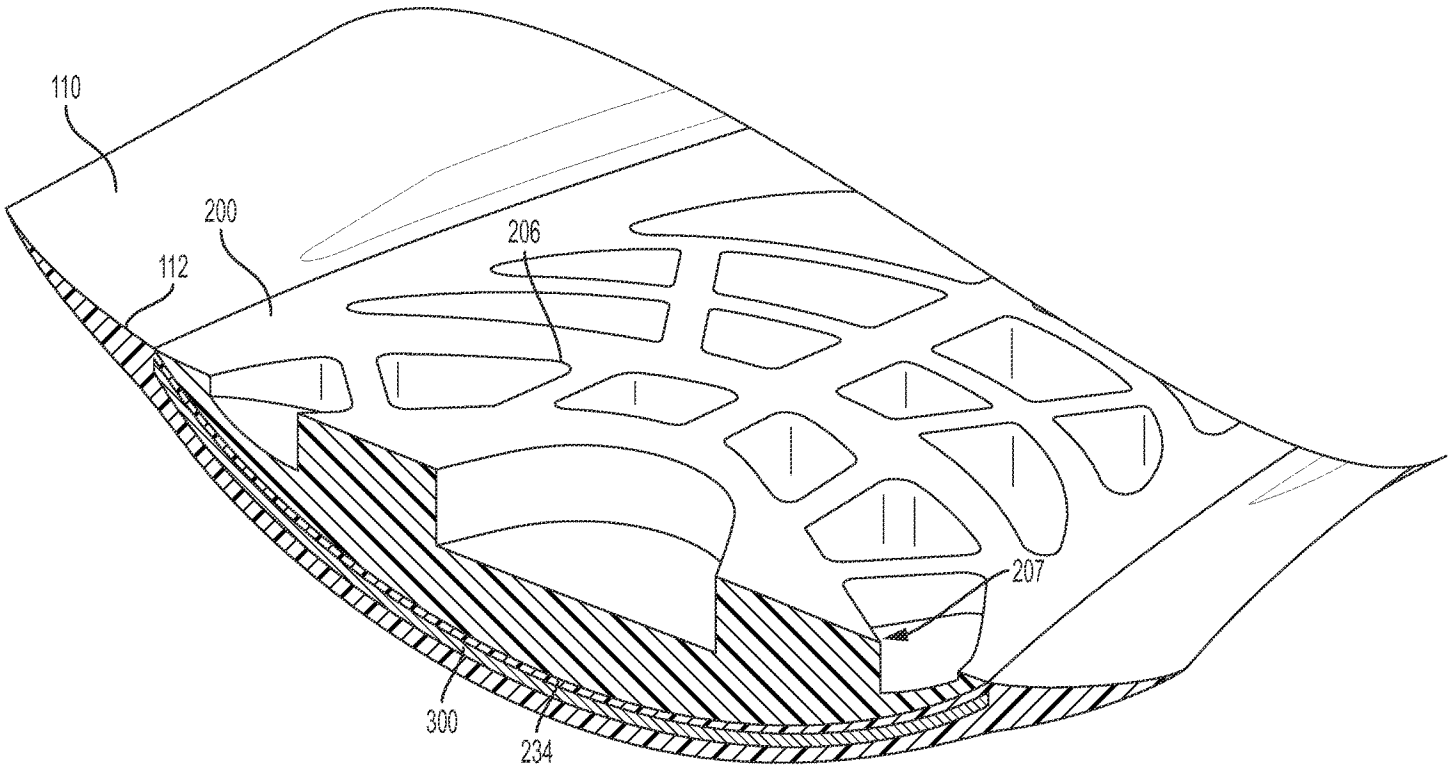
FIG. 8 is a schematic cut-away view taken along a midfoot region of the sole assembly of FIG. 6.
Figure 9:
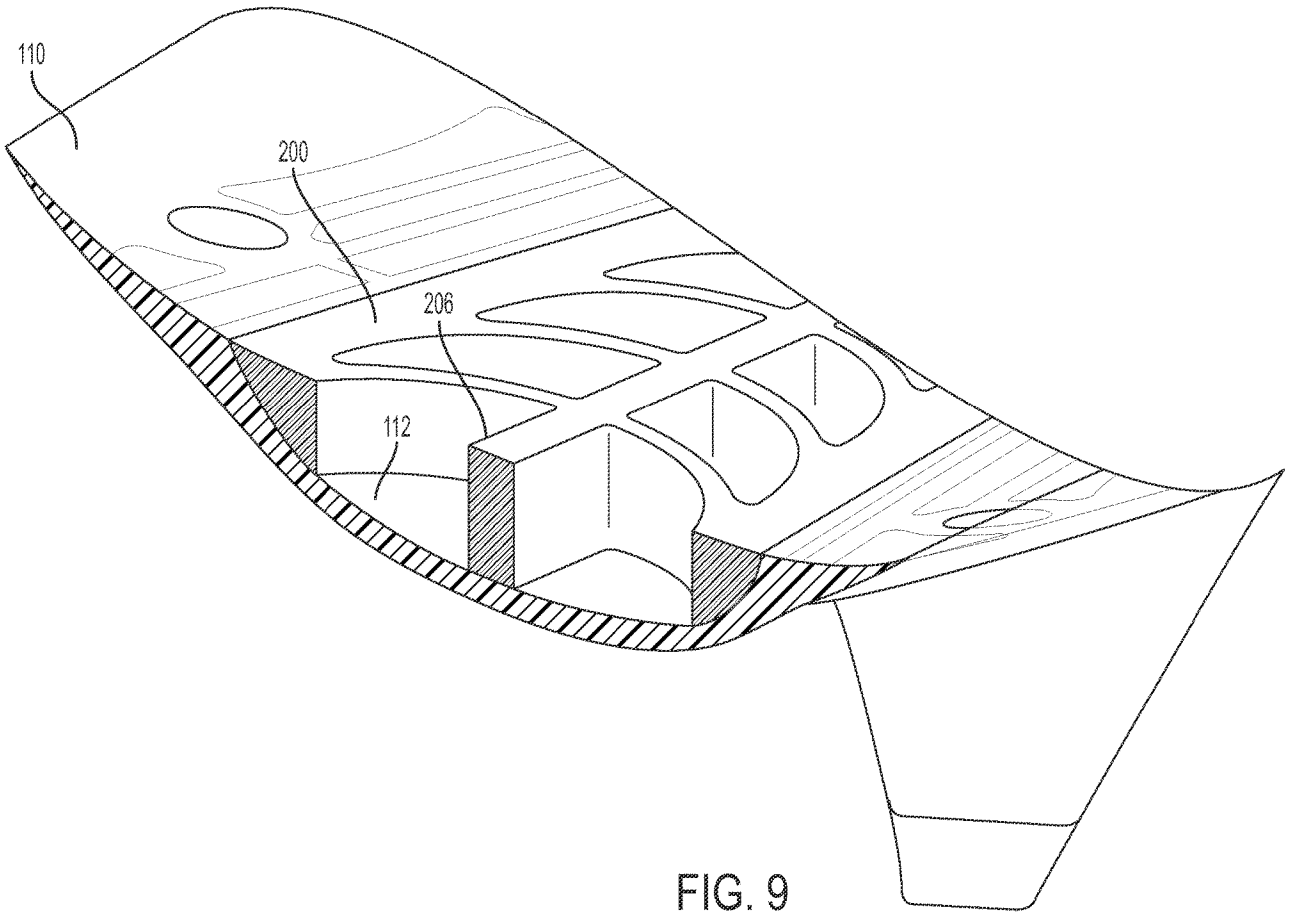
FIG. 9 is a schematic cut-away view taken along a heel region of the sole assembly of FIG. 6.

The reinforcing member may have a geometry configured to fit within recesses of a chassis while also providing an approximately flat inner surface for receiving an insole, a layer of the upper, or a foot. As best depicted in FIGS. 7-9, in some embodiments, some portions of reinforcing member 200 have a rounded outer (or lower) surface to match the contours of recesses in chassis 110 and forefoot plate 300. For example, lateral forefoot portion 202 is seen to have a rounded outer surface 230 that conforms in shape to the shape of lateral forefoot recess 124 (see FIG. 2). Likewise, medial forefoot portion 204 may have a rounded outer surface 232 that conforms to the rounded shape of medial forefoot recess 126 (see FIG. 2). In some embodiments, central portion 206 may also have a rounded outer surface 234 that conforms to the rounded shape of central recess 138. Alternatively, in other embodiments, the shapes of one or more surfaces of a reinforcing member may be different from the shapes of corresponding recesses.

A reinforcing member may also include one or more ribs or other support structures. As seen in FIG. 2, each portion of reinforcing member 200 includes a plurality of ribs. Lateral forefoot portion 202 and medial forefoot portion 204 comprise a first plurality of ribs 240 and a second plurality of ribs 242, respectively. Additionally, central portion 206 includes a plurality of ribs 244. These ribs may help provide increased strength and rigidity while minimizing weight. Details of the particular geometric arrangements of these ribs are discussed in further detail below and shown in FIG. 11.

Figure 4:
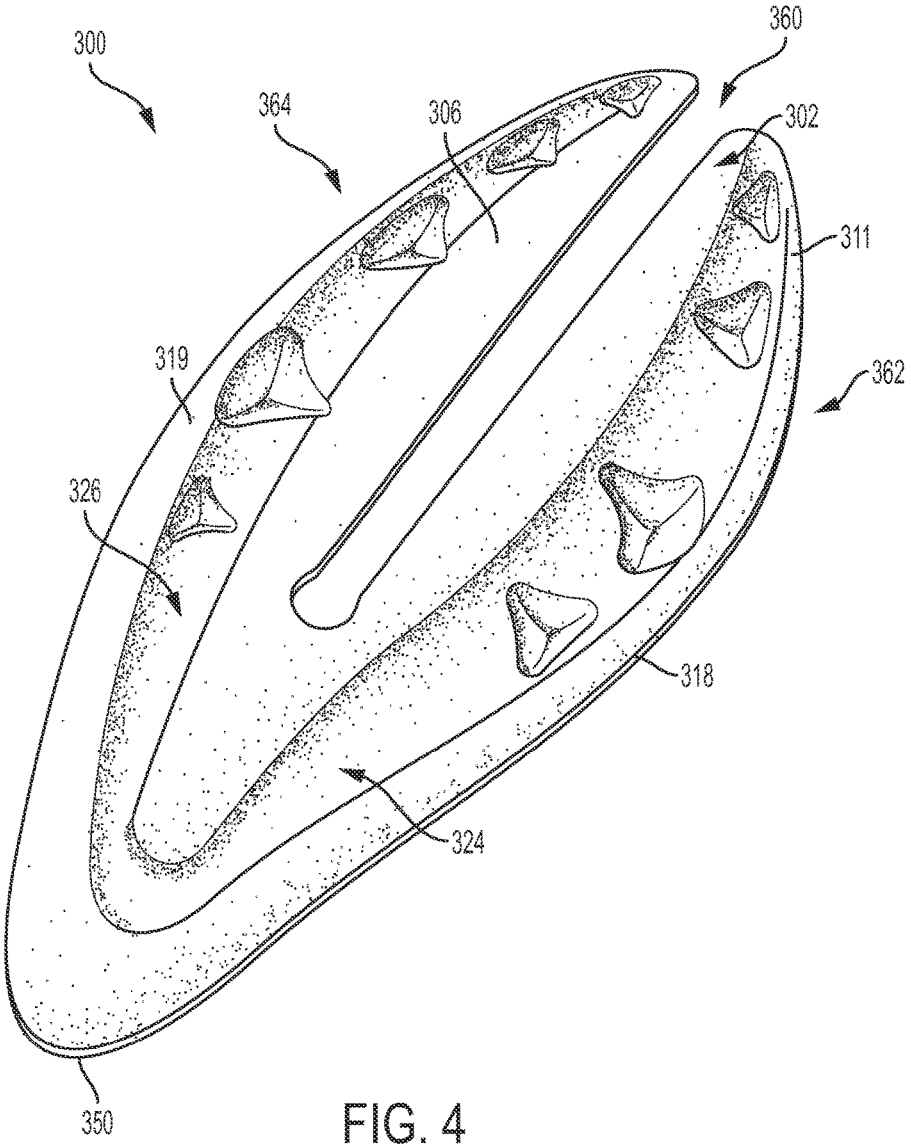
FIG. 4 is a schematic view of an embodiment of a forefoot plate, in which an inner surface of the forefoot plate is visible.
Figure 5:
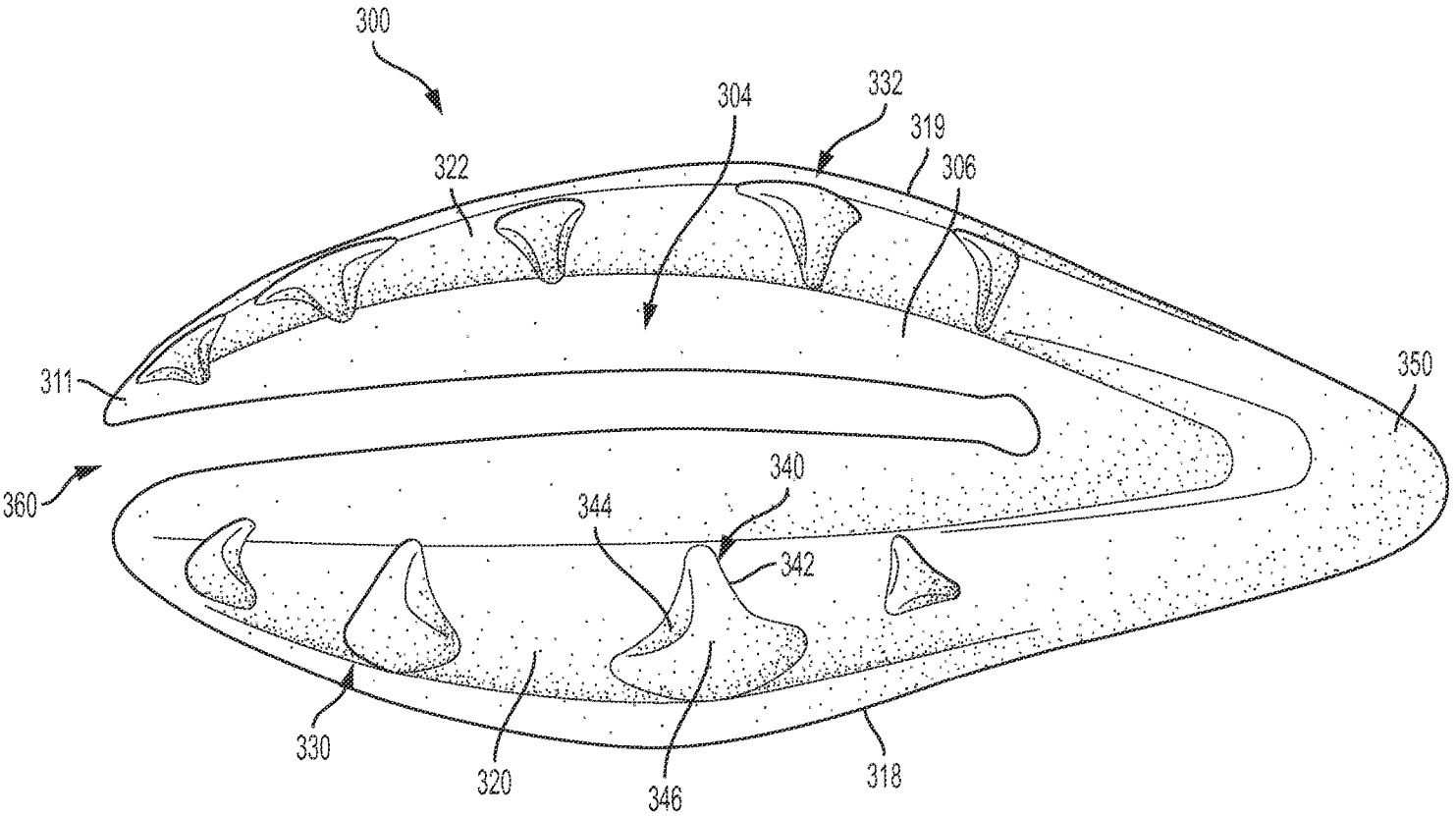
FIG. 5 is a schematic view of an opposing side of the forefoot plate shown in FIG. 4, in which an outer surface of the forefoot plate is visible.

FIGS. 4 and 5 illustrate schematic views of an inner side and an outer side, respectively, of forefoot plate 300. Forefoot plate 300 is configured as a partial-length plate, and may extend primarily through forefoot region 10 of chassis 110 with a posterior end of forefoot plate 300 also extending into midfoot region 12.

Referring to FIGS. 4 and 5, forefoot plate 300 may include an inner surface 302 (seen in FIG. 4) and an outer surface 304 (seen in FIG. 5). Inner surface 302 may be disposed closer to inner void 105 (see FIG. 1) of article 101 than outer surface 304. Forefoot plate 300 may also include a plate base 306 that extends approximately in the longitudinal and lateral directions of sole assembly 100. Plate base 306 may be generally sized and shaped to support the forefoot of a foot.

Some embodiments of a forefoot plate may include one or more ridges that may increase stiffness across the forefoot plate. The ridges may also include recesses to receive corresponding ridges or portions in adjacent structures (e.g., portions of a reinforcing member). Generally, a ridge may protrude or extend from a plate base of a forefoot plate. In some embodiments, a ridge may be hollow and may thereby provide a recess on the inner surface of the forefoot plate. In other embodiments, a ridge could be solid, or 'filled in', and may not be associated with any corresponding recesses. Ridges may furthermore be located anywhere on a forefoot plate (e.g., the lateral side or medial side). Still further, ridges could be configured in different orientations in different embodiments, including longitudinal orientations, lateral orientations or any orientation along an axis at an angle to the longitudinal and lateral orientations. It may be appreciated that the indicated orientations of a ridge may only be approximate, as the ridges may curve or turn in their extent through the forefoot plate and need not follow a single linear axis.

As shown in FIG. 5, forefoot plate 300 includes a lateral plate ridge 320 protruding from plate base 306 on outer surface 304 of forefoot plate 300. Lateral plate ridge 320 extends longitudinally through forefoot plate 300 and proximate a lateral edge 318 of forefoot plate 300. In addition, forefoot plate 300 includes a medial plate ridge 322 protruding from plate base 306 on outer surface 304 of forefoot plate 300. Medial plate ridge 322 extends longitudinally through forefoot plate 300 and proximate a medial edge 319 of forefoot plate 300. Furthermore, in the exemplary embodiment of FIG. 5, both lateral plate ridge 320 and medial plate ridge 322 extend to a location proximate an anterior edge 311 of forefoot plate 300 (i.e., both plate ridges extend to locations located beneath the toes when an article with sole assembly 100 is worn).

Each forefoot ridge is convex on outer surface 304 and concave on inner surface 302. Thus, each ridge provides a corresponding recess for forefoot plate 300 on inner surface 302. As seen in FIG. 4, lateral plate ridge 320 forms a lateral plate recess 324 on inner surface 302 and medial plate ridge 322 forms a medial plate recess 326 on inner surface 302. In the exemplary embodiment, each ridge further has a generally rounded cross-sectional shape (see FIG. 7). In particular, both lateral plate ridge 320 and medial plate ridge 322 may be characterized as having a hollow ridge or channel cross-sectional geometry. The cross-sectional geometry may further be rounded without any sharp corners.

In some embodiments, both a lateral plate ridge and a medial plate ridge may include one or more protrusions. The protrusions may be disposed in locations of the forefoot plate underlying one or more cleats, and may act to dissipate forces through regions adjacent the cleats to minimize the formation of "hotspots". For example, as best shown in FIG. 5, lateral plate ridge 320 includes a set of lateral protrusions 330 that protrude from lateral plate ridge 320 on outer surface 304 of forefoot plate 300. Similarly, medial plate ridge 322 includes a set of medial protrusions 332 that extend from medial plate ridge 322 on outer surface 304 of forefoot plate 300.

The geometry of the protrusions on forefoot plate 300 may enhance the dissipation of forces away from a single region directly 'under' each cleat. For clarity, the geometry of an exemplary protrusion 340 is described in reference to FIG. 5. The remaining protrusions may also have a similar geometry to protrusion 340. As shown, protrusion 340 includes three edges 342 at its base (i.e., where protrusion 340 extends away from ridge 320). From its base, faces 344 extend from edges 342 at a relatively steep slope and then gradually curve to meet at central plateau 346. Plateau 346 provides an approximately flat region directly beneath a cleat (see FIG. 10), and thereby allows forces to be more effectively directed away from a single point or small region under the cleat.

As apparent from FIGS. 4-5, lateral plate ridge 320 and medial plate ridge 322 may merge at a posterior end of forefoot plate 300. In particular, lateral plate ridge 320 and medial plate ridge 322 merge at a location proximate posterior edge 350 of forefoot plate 300.

In some embodiments, a forefoot plate may include one or more gaps, openings or slots that may modify the plate's stiffness and flexibility. Referring to FIGS. 4-5, forefoot plate 300 includes a longitudinal gap 360 that extends from an anterior edge 311 of forefoot plate 300 to a location anterior to where lateral plate ridge 320 and medial plate ridge 322 merge at the posterior end of forefoot plate 300. Longitudinal gap 360 may separate forefoot plate 300 into a lateral plate section 362 and a medial plate section 364, which are joined together at the posterior end of forefoot plate 300 and separated throughout the remainder of forefoot plate 300. This separation may allow lateral plate section 362 and medial plate section 364 to bend somewhat independently of one another, allowing for a more natural motion in the forefoot as one side of the forefoot contacts the ground before the other side during running.

In some embodiments, chassis 110 may include one or more cleats or other traction elements disposed centrally in forefoot region 10. Referring to FIG. 3, a plurality of centrally located cleats 181 (four in total) are disposed in forefoot region 10. Each of these cleats partially underlies a material portion of forefoot plate 300 as well as some of gap 360 (see FIG. 4). Such a configuration may facilitate improved traction in the forefoot and may help reinforce the portion of chassis directly beneath gap 360.

Figure 6:
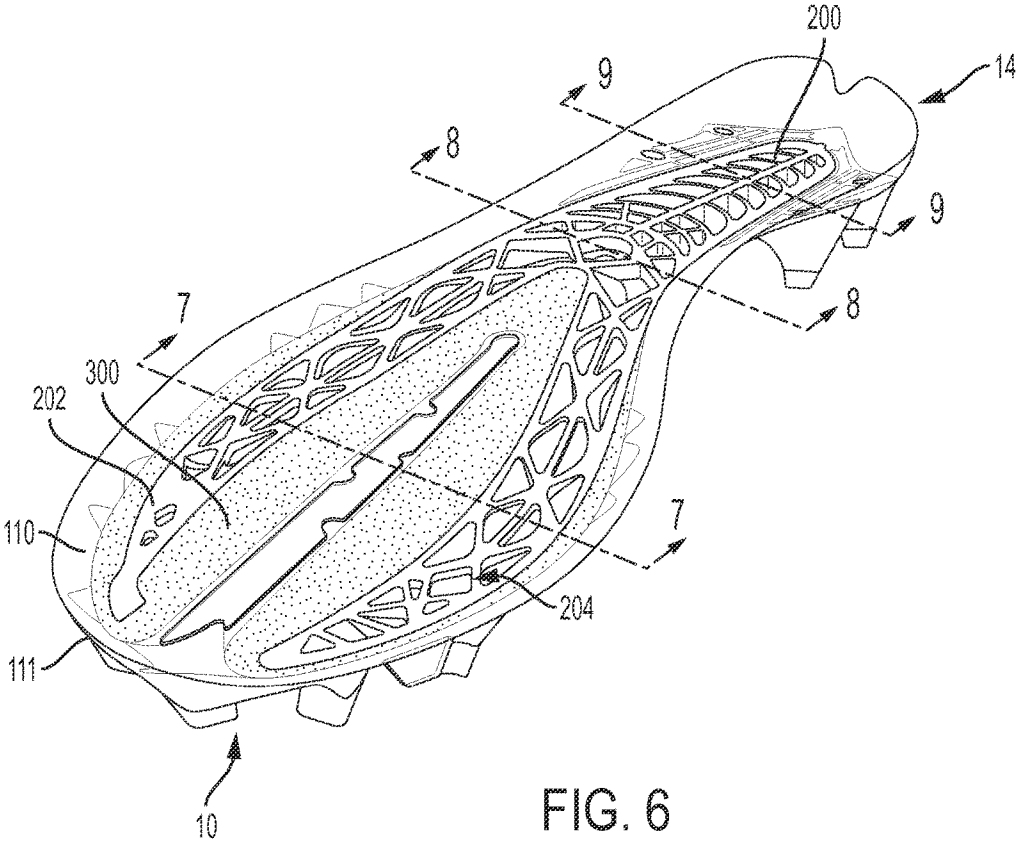
FIG. 6 is a schematic view of a sole assembly according to an embodiment.

FIG. 6 is a schematic view of sole assembly 100, in which several cross-sectional views are also shown along different longitudinal locations of sole assembly 100. FIGS. 7-9 are various schematic cut-away views taken at lines indicated in FIG. 6. Referring to FIGS. 6-9, chassis 110 fits with both forefoot plate 300 and reinforcing member 200. Specifically, outer surface 304 of forefoot plate 300 is disposed between an inner layer 177 of chassis 110 and an outer layer 179 of chassis 110. Here, inner layer 177 and outer layer 179 are not necessarily distinct structures within chassis 110, and may generally indicate the outermost and innermost portions of chassis 110. Furthermore, as previously described, the geometry of outer surface 304 of forefoot plate 300 fits with the geometry chassis 110 in forefoot region 10 so that the plate ridges of forefoot plate 300 fit into the forefoot ridges of chassis 110.

Moreover, central portion 206 of reinforcing member 200 is disposed against (i.e., contacts) inner surface 112 of chassis 110 in midfoot region 12 and heel region 14. In addition, lateral forefoot portion 202 and medial forefoot portion 204 are disposed against inner surface 112 of chassis 110, and proximate outer surface 302 of forefoot plate 300. In particular, the geometry of inner surface 302 of forefoot plate 300 fits lateral forefoot portion 202 and medial forefoot portion 204 so that the entirety of lateral plate ridge 320 and medial plate ridge 322 may be filled and reinforced. Still further, an anterior portion 207 of central portion 206 is received within the location of forefoot plate 300 where lateral plate recess 324 and medial plate recess 326 converge into a single recess.

In order to ensure the entire forefoot is sufficiently supported, the embodiments utilize a full length reinforcing member that extends from an anterior end of the chassis to a posterior end of the chassis. As seen in FIG. 6, lateral forefoot portion 202 and medial forefoot portion 204 extend at their forward-most ends to locations proximate anterior edge 111 of chassis 110. This ensures that the forefoot of sole assembly 100 is sufficiently stiff even beneath the toes of the foot.

In order to provide the desired structural properties in different regions of a sole assembly, components may have different structural characteristics (e.g., stiffness, flexibility, etc.). In different embodiments, the relative structural properties of two or more components could vary. For example, depending on the embodiment, a forefoot plate could be more or less stiff than a reinforcing member or than a chassis. As used herein, stiffness may refer to any of bending stiffness, compressive stiffness, shear stiffness or torsional stiffness. In an embodiment shown in the figures, forefoot plate 300 may be stiffer than reinforcing member 200 and reinforcing member 200 may be stiffer than chassis 110. Specifically, forefoot plate 300 may have a greater bending stiffness than reinforcing member 200 and reinforcing member 200 may have a greater bending stiffness than chassis 110. Thus, forefoot plate 300 and reinforcing member 200 together form a reinforced internal structure for the more flexible chassis 110.

In different embodiments, the types of materials used to make one or more components of a sole assembly could vary. The type of materials used for a particular part may be selected according to desired structural characteristics of the part as well as according to various manufacturing considerations (cost, material availability, etc.). Exemplary materials that may be used in making a chassis include, but are not limited to: various plastics, thermoplastics (such as thermoplastic polyurethane), foams, resins, rubbers as well as any other kinds of materials. Exemplary materials that may be used in making a reinforcing member include, but are not limited to: various plastics, thermoplastics (such as thermoplastic polyurethane), foams, resins, rubbers as well as any other kinds of materials. Exemplary materials that may be used in making a forefoot plate include, but are not limited to: metal and composite materials (e.g., carbon fiber composites, glass fiber composites, etc.) as well as any other kinds of materials. In one embodiment, chassis 110 could be made of a material including thermoplastic polyurethane, reinforcing member 200 could be made of a material including thermoplastic polyurethane and forefoot plate 300 could be made of a material including a carbon-fiber composite material. In at least some embodiments, cleat tips (e.g., cleat tips 199 in FIG. 2) could be made of similar materials to chassis 110 or reinforcing member 200.

Embodiments can be configured to reduce point loading due to cleats, since point loading can result in "hotspots." As previously mentioned, point loading can be mitigated in the embodiments by the presence of protrusions in forefoot plate 300.

Figure 10:
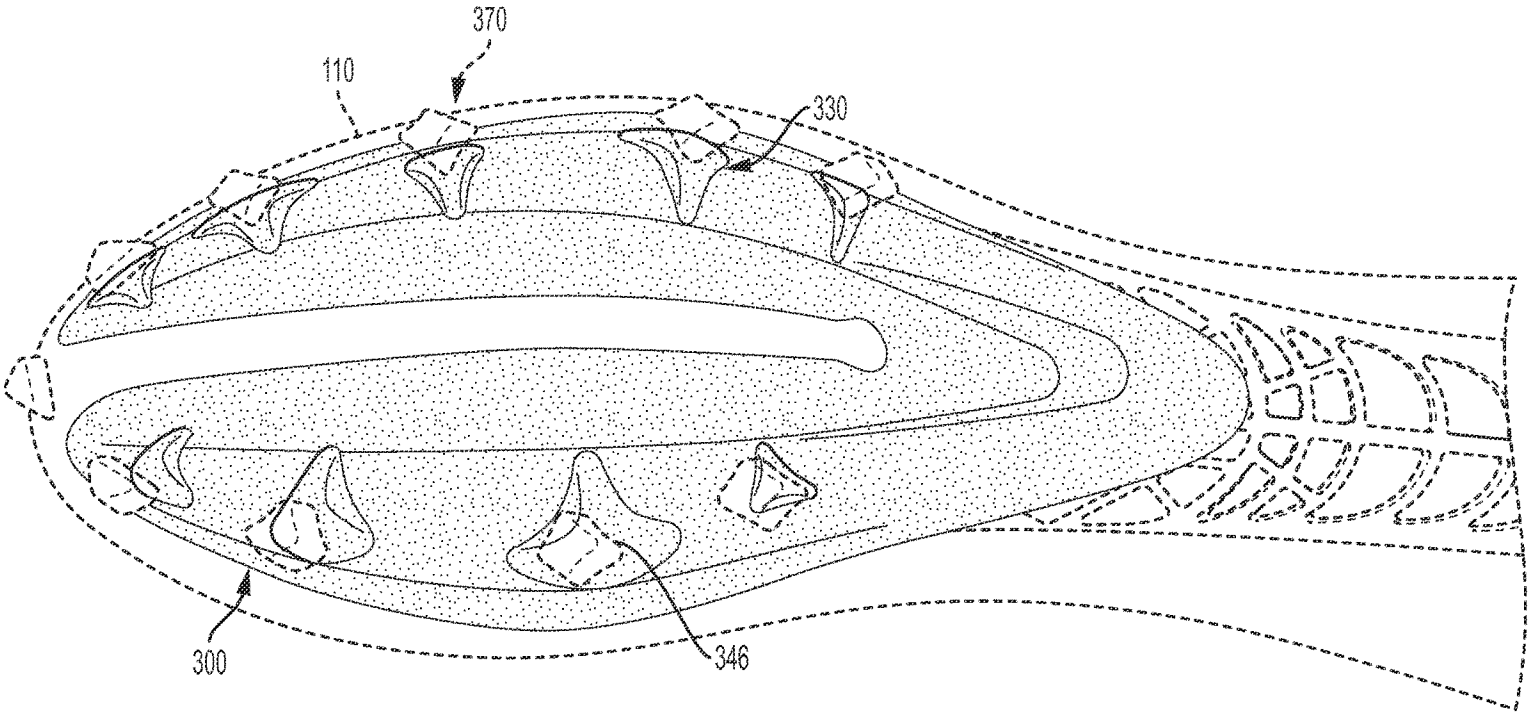
FIG. 10 is a schematic view of an outer side of a sole assembly with a chassis shown in phantom, according to an embodiment.

FIG. 10 is a schematic view of a bottom side of sole assembly 100. For purposes of clarity, chassis 110 is shown in phantom. Referring to FIG. 10, the protrusions of forefoot plate 300 may be seen to correspond with cleats of chassis 110. More specifically, the protrusions of forefoot plate 300 may be vertically aligned with the cleat protrusions of chassis 110. For example, set of lateral protrusions 330 are vertically aligned with set of lateral cleats 370 of chassis 110. Further, set of medial protrusions 332 are vertically aligned with set of medial cleats 372 of chassis 110. This arrangement allows forces from the underlying cleats to be transferred the protrusions and further directed out along a plate ridge (lateral plate ridge 320 in this case). For purposes of illustration, the cleats in FIG. 10 are represented by their cleat tips, but it may be understood that the cleat protrusions of chassis 110 are also present and may be mounted about the protrusions on forefoot plate 300. Moreover, the protrusions of chassis 110 may rest directly on the plateaus (e.g., plateau 346) of the protrusions. This arrangement may allow forces to be directly transferred from each cleat to an underlying cleat protrusion where the forces may be dissipated out along the protrusion as well as along the corresponding plate ridge.

Figure 11:
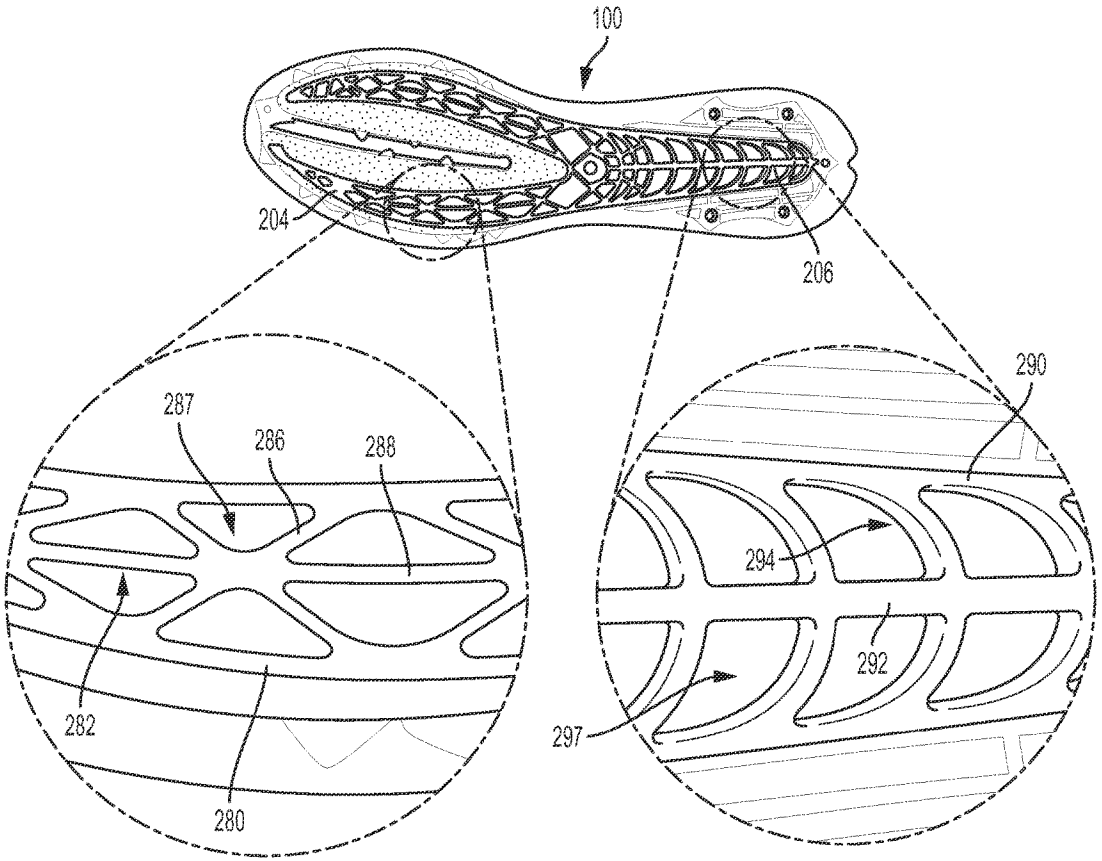
FIG. 11 is a schematic view of a sole assembly including enlarged views of different rib patterns in a reinforcing member, according to an embodiment.

FIG. 11 is a schematic view of sole assembly 100 including enlarged views of the various rib patterns in reinforcing member 200. In lateral forefoot portion 202 and medial forefoot portion 204, the rib patterns are generally linear, and comprise relatively straight ribs. For example, medial forefoot portion 204 includes a peripheral edge 280 (extending fully around the perimeter of medial forefoot portion 204) and a series of connected central ribs 282. Further, a plurality of straight ribs 284 extend between peripheral edge 280 and central ribs 282. As one specific example, straight rib 286 extends from peripheral edge 280 to central rib 288. Plurality of straight ribs 284 are generally arranged in an X-like lattice configuration, with the central ribs 282 extending through the center of adjacent X-shaped groups. Plurality of straight ribs 282 and central ribs 282 may also be characterized as forming a lattice pattern. This pattern of ribs results in a pattern of triangular shaped blind holes that are bounded below by outer surface 232 of medial forefoot portion 204.

In contrast, the rib pattern in central portion 206 differs from the pattern present in the forefoot portions of reinforcing member 200. Central portion 206 is also comprised of a peripheral edge 290 as well as a long single central rib 292. However, ribs extending between peripheral edge 290 and central rib 292 are curved, rather than straight. The plurality of curved ribs 294 each have a generally rounded shape that curves in a forward direction as they extend from central rib 292 to a location on peripheral edge 290. This pattern of ribs results in a pattern of through holes 297 with a fin-like shape that are open on the interior and exterior surfaces of reinforcing member 200.

Using different rib patterns along different portions of a reinforcing member may allow for tuning of some structural characteristics at each portion. For example, using straight vs. curved ribs, as well as using a through hole design (no continuous surface spanning across the peripheral edge of a portion) vs. a blind hole design (a backing surface spans across the peripheral edge of the portion) may provide for differences in stiffness, torsional resistance, flexibility and other structural properties for a portion. Thus, in the exemplary embodiment of FIG. 11, the lateral and medial forefoot portions may have different structural characteristics than the central portion, due not only to differences in shape and size, but also to the particular arrangement of ribs within each portion. This allows reinforcing member 200 to provide different kinds of reinforcement within the forefoot region vs the midfoot and heel regions of sole assembly 100.

Some embodiments can include provisions that enhance the visual design of a sole assembly. As best seen in FIG. 3, in at least some embodiments, chassis 110 may be made of a translucent plastic. This allows someone viewing the underside of chassis 110 to see forefoot plate 300 in the forefoot, as well as central portion 206 of reinforcing member 200.

Figure 12:
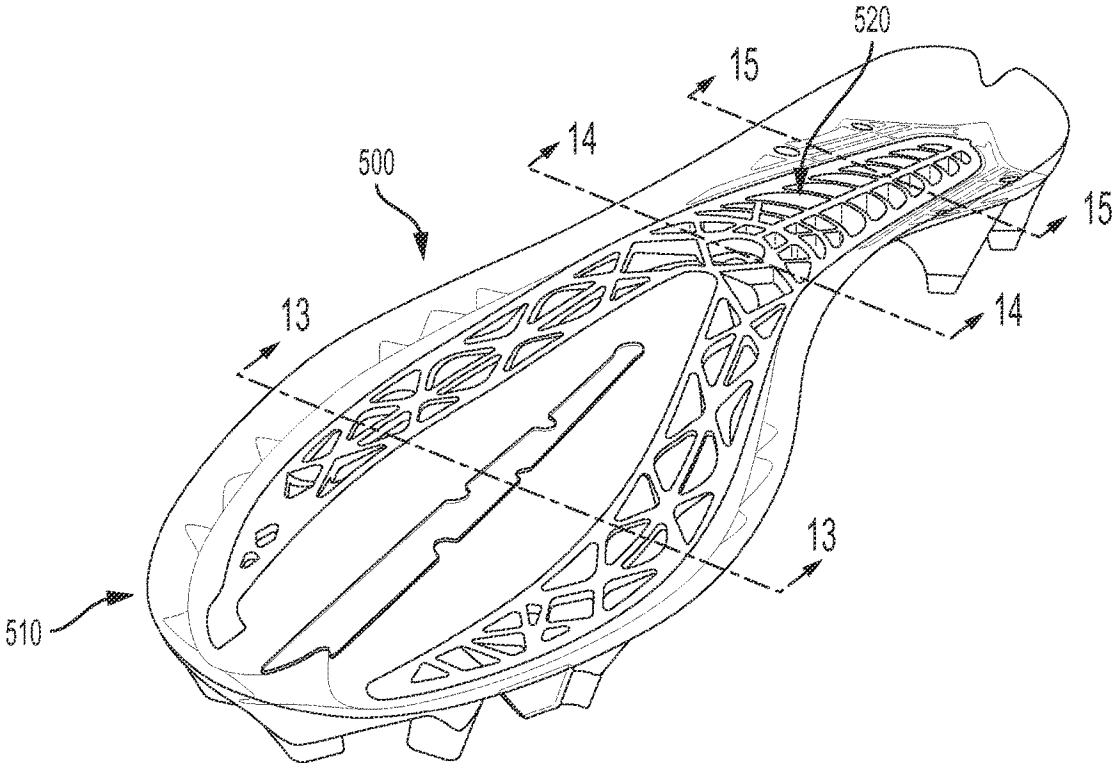
FIG. 12 is a schematic view of a sole assembly, according to another embodiment.
Figure 13:
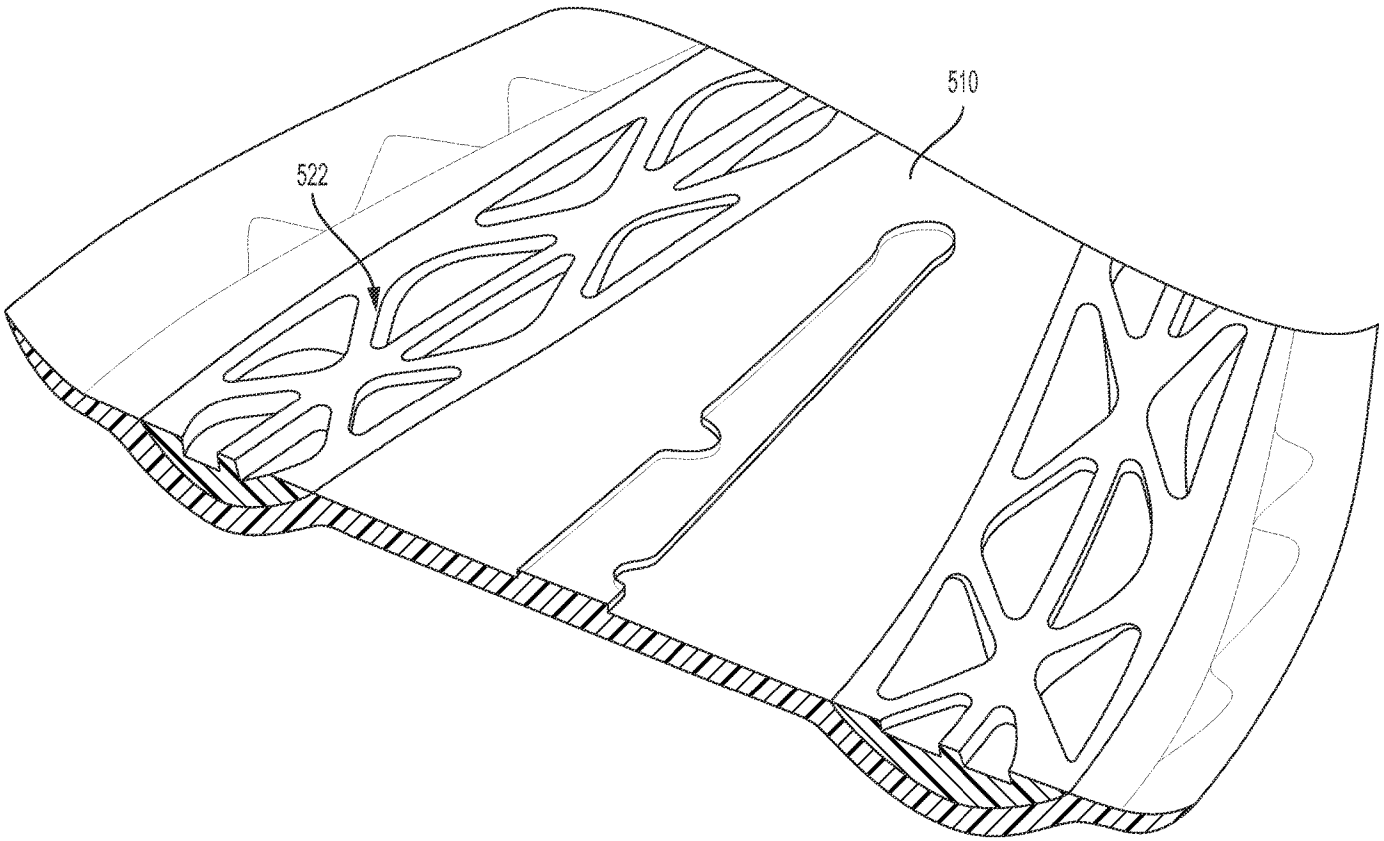
FIG. 13 is a schematic cut-away view taken along a forefoot region of the sole assembly of FIG. 12.
Figure 14:
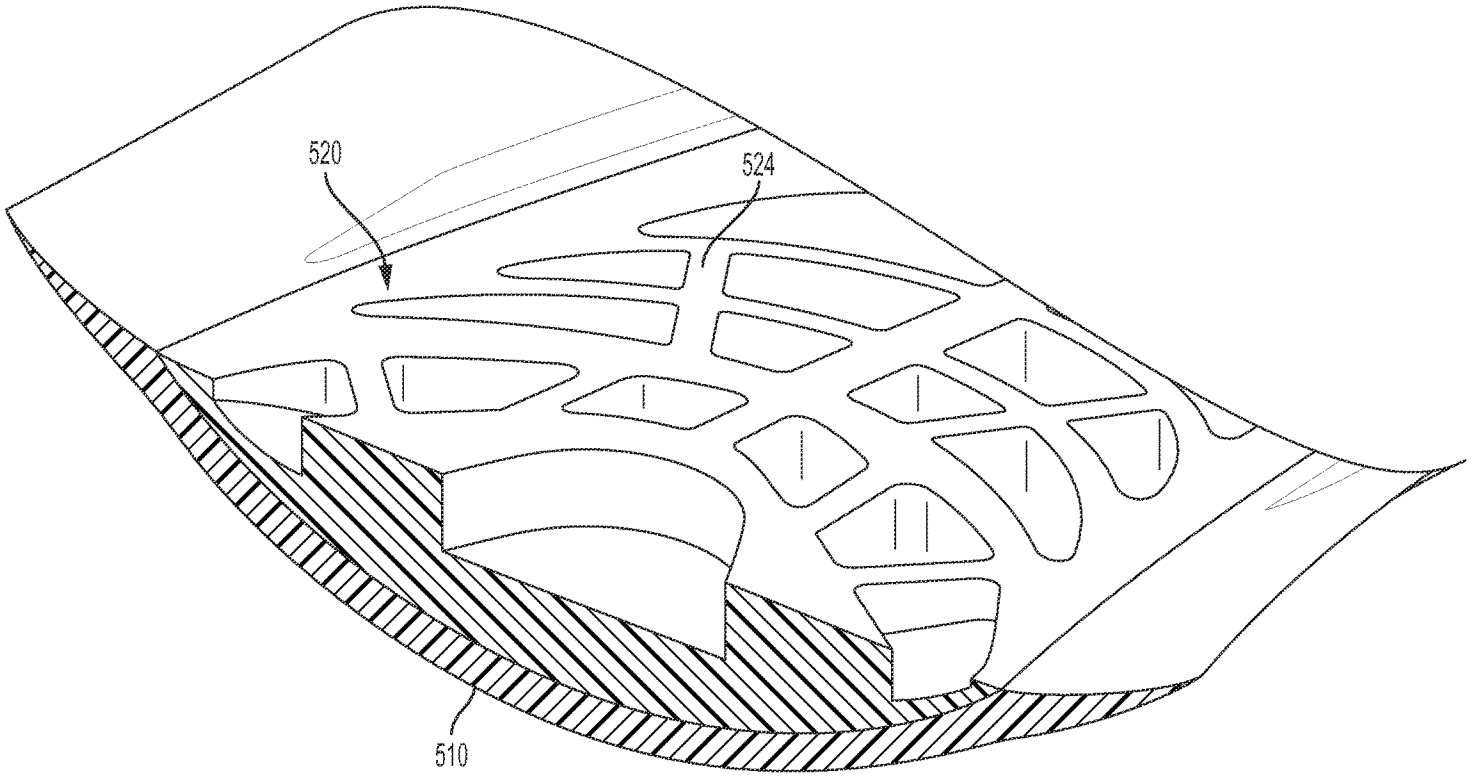
FIG. 14 is a schematic cut-away view taken along a midfoot region of the sole assembly of FIG. 12.
Figure 15:
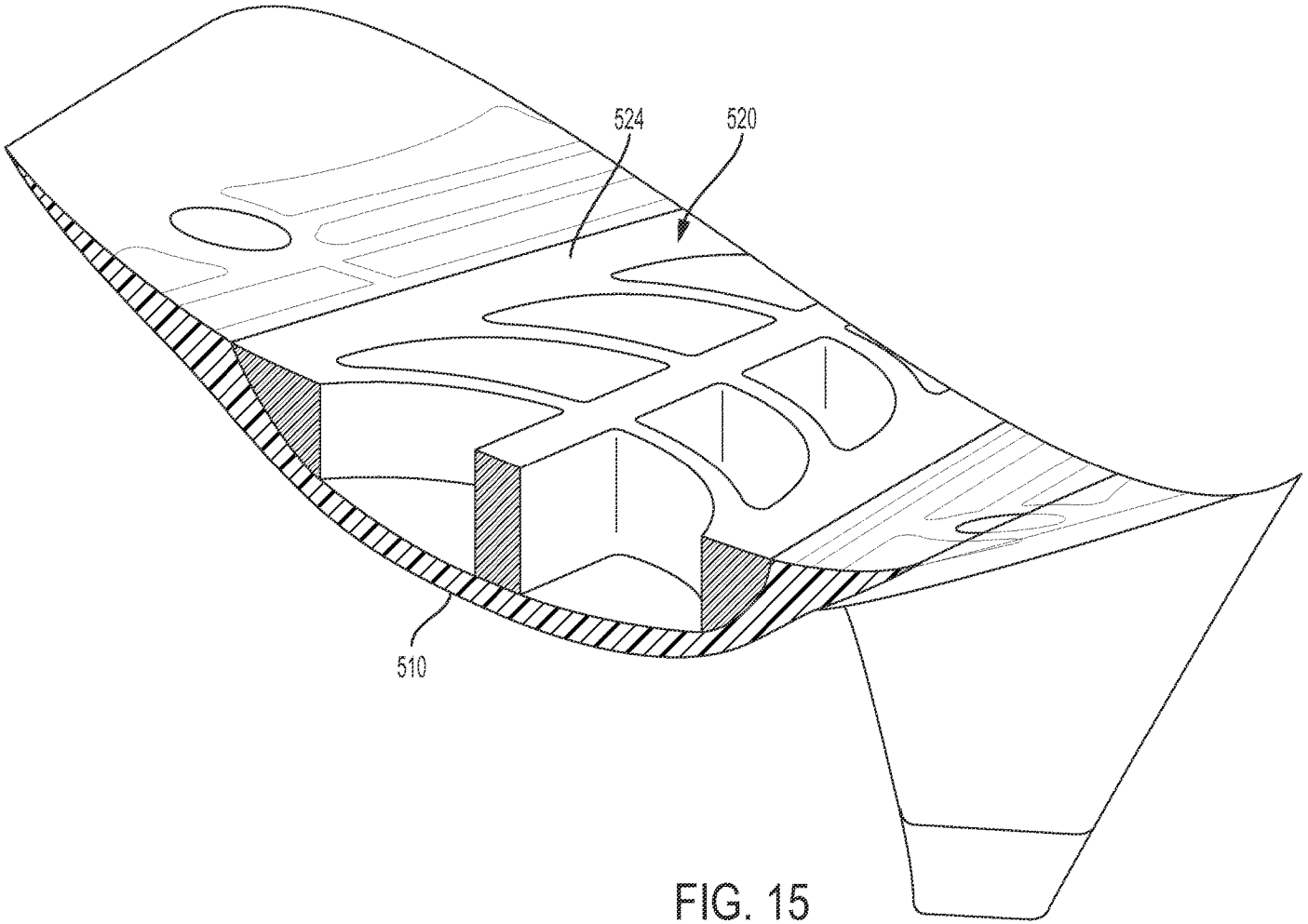
FIG. 15 is a schematic cut-away view taken along a heel region of the sole assembly of FIG. 12.

FIG. 12 is a schematic view of an alternative embodiment of a sole assembly 500. FIGS. 13-15 illustrate various cut-away views of portions of sole assembly 500 along lines indicated in FIG. 12. Referring to FIGS. 12-15, the embodiments depicted may share many of the features of the embodiment of sole assembly 100 depicted, for example, in FIGS. 6-9. However, in contrast to the embodiment shown in FIGS. 6-9, the embodiments depicted in FIGS. 12-15 lacks a forefoot plate. Instead, sole assembly 500 includes only a chassis 510 and a reinforcing member 520. Moreover, chassis 510 and reinforcing member 520 are seen to fit together so that the medial and lateral forefoot portions 522 of reinforcing member 520 fill in the corresponding recesses in chassis 510. A central portion 524 of reinforcing member 520 also fills in a corresponding recess in chassis 510. This arrangement provides for continual contact between reinforcing member 520 and chassis 510 through the entire length of chassis 510. This embodiment may be utilized when it is desirable to provide less stiffness in the forefoot than would be provided by an embodiment incorporating a forefoot plate. Although not shown, it is contemplate that in other embodiments lacking a forefoot plate a reinforcing member could include protrusions on an outer surface of a lateral and/or medial portion (at locations corresponding with cleats) to help dissipate point loading applied by the cleats.

While various embodiments have been described, the description is intended to be exemplary, rather than limiting, and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

What is claimed is:

1. An article of footwear with an upper and a sole assembly, the upper having an inner void, and the sole assembly further comprising:

a chassis with a forefoot region, a midfoot region, and a heel region, the chassis further comprising;

an outer surface and an opposing inner surface, the inner surface being disposed closer to the inner void than the outer surface;

a base;

a lateral forefoot ridge protruding from the base on the outer surface of the chassis and extending longitudinally through the forefoot region of the chassis and proximate a lateral edge of the chassis;

a medial forefoot ridge protruding from the base on the outer surface of the chassis and extending longitudinally through the forefoot region of the chassis and proximate a medial edge of the chassis;

the lateral forefoot ridge including a plurality of lateral cleat protrusions and the medial forefoot ridge including a plurality of medial cleat protrusions on the outer surface of the chassis;

the lateral forefoot ridge and the medial forefoot ridge merging in the midfoot region of the chassis to form a central ridge that extends through the midfoot region and through the heel region of the chassis;

the lateral forefoot ridge forming a lateral forefoot recess on the inner surface of the chassis and the medial forefoot ridge forming a medial forefoot recess on the inner surface of the chassis;

the central ridge forming a central recess on the inner surface of the chassis;

a reinforcing member, further comprising:

a lateral forefoot portion filling in the lateral forefoot recess;

a medial forefoot portion filling in the medial forefoot recess;

a central portion filling in the central recess; and wherein the lateral forefoot portion and the medial forefoot portion extend to an anterior edge of the chassis.

2. The article of footwear according to claim 1, wherein a distance between an interior edge of the lateral forefoot portion and an interior edge of the medial forefoot portion is greater than a widest portion of the lateral forefoot portion; and wherein the distance is greater than a widest portion of the medial forefoot portion.

3. The article of footwear according to claim 1, wherein the lateral forefoot portion and the medial forefoot portion are reinforced by a plurality of ribs.

4. The article of footwear according to claim 1, wherein the central portion is reinforced using a plurality of ribs.

5. The article of footwear according to claim 1, wherein:

the chassis includes a first set of heel cleat protrusions on a medial edge of the heel region of the chassis and a second set of heel cleat protrusions on a lateral edge of the heel region of the chassis; and wherein the central ridge passes between the first set of heel cleat protrusions and the second set of heel cleats protrusions.

6. The article of footwear according to claim 1, wherein the sole assembly includes a forefoot plate embedded in the chassis, the forefoot plate having a posterior edge disposed in the midfoot region of the chassis.

7. The article of footwear according to claim 6, wherein the forefoot plate has an outer plate surface that fits with the lateral forefoot recess of the chassis and with the medial forefoot recess of the chassis; and wherein the forefoot plate has an inner plate surface that receives the lateral forefoot portion and the medial forefoot portion of the reinforcing member.

8. An article of footwear with an upper and a sole assembly, the upper having an inner void, and the sole assembly further comprising:

a chassis with a forefoot region, a midfoot region, and a heel region, the chassis further comprising;

an outer surface and an opposing inner surface, the inner surface being disposed closer to the inner void than the outer surface;

a base;

a lateral forefoot ridge protruding from the base on the outer surface of the chassis and extending longitudinally through the forefoot region of the chassis and proximate a lateral edge of the chassis;

a medial forefoot ridge protruding from the base on the outer surface of the chassis and extending longitudinally through the forefoot region of the chassis and proximate a medial edge of the chassis;

the lateral forefoot ridge including a plurality of lateral cleat protrusions and the medial forefoot ridge including a plurality of medial cleat protrusions on the outer surface of the chassis;

the lateral forefoot ridge and the medial forefoot ridge merging in the midfoot region of the chassis to form a central ridge that extends through the midfoot region and through the heel region of the chassis;

the lateral forefoot ridge forming a lateral forefoot recess on the inner surface of the chassis and the medial forefoot ridge forming a medial forefoot recess on the inner surface of the chassis;

the central ridge forming a central recess on the inner surface of the chassis;

a forefoot plate with an outer plate surface and an inner plate surface, the forefoot plate further comprising:

a plate base;

a lateral plate ridge protruding from the plate base on the outer plate surface of the forefoot plate and extending longitudinally through the forefoot plate and proximate a lateral edge of the forefoot plate;

a medial plate ridge protruding from the plate base on the outer plate surface of the forefoot plate and extending longitudinally through the forefoot plate and proximate a medial edge of the forefoot plate;

the lateral plate ridge fitting within the lateral forefoot ridge of the chassis and a medial plate ridge fitting within the medial forefoot ridge of the chassis; and the lateral plate ridge and the medial plate ridge merging at a posterior end of the forefoot plate.

9. The article of footwear according to claim 8, wherein:

the chassis includes a set of lateral cleats disposed on a lateral side of the chassis and wherein the chassis includes a set of medial cleats disposed on a medial side of the chassis;

wherein the lateral plate ridge includes a set of lateral protrusions on the outer plate surface, the set of lateral protrusions being vertically aligned with the set of lateral cleats of the chassis; and wherein the medial plate ridge includes a set of medial protrusions on the outer plate surface, the set of medial protrusions being vertically aligned with the set of lateral cleats of the chassis.

10. The article of footwear according to claim 8, wherein the forefoot plate includes a longitudinal gap extending from an anterior edge of the forefoot plate to a location anterior to where the lateral plate ridge and the medial plate ridge merge at the posterior end of the forefoot plate.

11. The article of footwear according to claim 8, wherein the forefoot plate has a greater bending stiffness than the forefoot region of the chassis.

12. The article of footwear according to claim 11, wherein the forefoot plate is made of a material including a carbon-fiber composite.

13. The article of footwear according to claim 8, wherein the lateral plate ridge forms a lateral recess on the inner plate surface of the forefoot plate; and wherein the medial plate ridge forms a medial recess on the inner plate surface of the forefoot plate.

14. The article of footwear according to claim 13, wherein:

the sole assembly further includes a reinforcing member;

wherein the reinforcing member includes a lateral forefoot portion filling in the lateral recess of the forefoot plate; and wherein the reinforcing member includes a medial forefoot portion filling in the medial recess of the forefoot plate.

15. The article of footwear according to claim 14, wherein the lateral forefoot portion and the medial forefoot portion merge to form a central portion filling in the central recess of the chassis.

16. An article of footwear with an upper and a sole assembly, the upper having an inner void, and the sole assembly further comprising:

a chassis with a forefoot region, a midfoot region, and a heel region, the chassis further comprising;

an outer surface and an opposing inner surface, the inner surface being disposed closer to the inner void than the outer surface;

a base;

a lateral forefoot ridge protruding from the base on the outer surface of the chassis and extending longitudinally through the forefoot region of the chassis and proximate a lateral edge of the chassis;

a medial forefoot ridge protruding from the base on the outer surface of the chassis and extending longitudinally through the forefoot region of the chassis and proximate a medial edge of the chassis;

the lateral forefoot ridge including a plurality of lateral cleat protrusions and the medial forefoot ridge including a plurality of medial cleat protrusions on the outer surface of the chassis;

the lateral forefoot ridge and the medial forefoot ridge merging in the midfoot region of the chassis to form a central ridge that extends through the midfoot region and through the heel region of the chassis;

the lateral forefoot ridge forming a lateral forefoot recess on the inner surface of the chassis and the medial forefoot ridge forming a medial forefoot recess on the inner surface of the chassis;

the central ridge forming a central recess on the inner surface of the chassis;

a reinforcing member, further comprising:

a lateral forefoot portion filling in the lateral forefoot recess;

a medial forefoot portion filling in the medial forefoot recess;

a central portion filling in the central recess in the midfoot region and in the heel region; and the central portion comprising a first peripheral edge, a first central rib, and a plurality of curved ribs extending from the first central rib to the first peripheral edge.

17. The article of footwear according to claim 16, wherein the lateral forefoot portion includes a second peripheral edge, a second central rib, and a first plurality of straight ribs extending from the second central rib to the second peripheral edge; and wherein the medial forefoot portion includes a third peripheral edge, a third central rib, and a second plurality of straight ribs extending from the third central rib to the third peripheral edge.

18. The article of footwear according to claim 16, wherein the central portion includes a plurality of through holes bounded by the first central rib, the first peripheral edge and the plurality of curved ribs.

19. The article of footwear according to claim 17, wherein the lateral forefoot portion includes a plurality of blind holes bounded on their sides by the second central rib, the second peripheral edge, and the first plurality of straight ribs; and wherein the plurality of blind holes are bounded below by a lower surface of the lateral forefoot portion.

20. The article of footwear according to claim 17, wherein the medial forefoot portion includes a plurality of blind holes bounded on their sides by the third central rib, the third peripheral edge, and the second plurality of straight ribs; and wherein the blind holes are bounded below by a lower surface of the medial forefoot portion.

21. A sole assembly further comprising:

a chassis with a forefoot region, a midfoot region, and a heel region, the chassis further comprising;

an outer surface and an opposing inner surface;

a base;

a lateral forefoot ridge protruding from the base on the outer surface of the chassis and extending longitudinally through the forefoot region of the chassis and proximate a lateral edge of the chassis;

a medial forefoot ridge protruding from the base on the outer surface of the chassis and extending longitudinally through the forefoot region of the chassis and proximate a medial edge of the chassis;

the lateral forefoot ridge including a plurality of lateral cleat protrusions and the medial forefoot ridge including a plurality of medial cleat protrusions on the outer surface of the chassis;

the lateral forefoot ridge and the medial forefoot ridge merging in the midfoot region of the chassis to form a central ridge that extends through the midfoot region and through the heel region of the chassis;

the lateral forefoot ridge forming a lateral forefoot recess on the inner surface of the chassis and the medial forefoot ridge forming a medial forefoot recess on the inner surface of the chassis;

the central ridge forming a central recess on the inner surface of the chassis;

a reinforcing member, further comprising:

a lateral forefoot portion filling in the lateral forefoot recess;

a medial forefoot portion filling in the medial forefoot recess;

a central portion filling in the central recess; and wherein the lateral forefoot portion and the medial forefoot portion extend to an anterior edge of the chassis.

22. The sole assembly according to claim 21, wherein a distance between an interior edge of the lateral forefoot portion and an interior edge of the medial forefoot portion is greater than a widest portion of the lateral forefoot portion; and wherein the distance is greater than a widest portion of the medial forefoot portion.

23. The sole assembly according to claim 21, wherein the lateral forefoot portion and the medial forefoot portion are reinforced by a plurality of ribs.

24. The sole assembly according to claim 21, wherein the central portion is reinforced using a plurality of ribs.

25. The sole assembly according to claim 21, wherein:

the chassis includes a first set of heel cleat protrusions on a medial edge of the heel region of the chassis and a second set of heel cleat protrusions on a lateral edge of the heel region of the chassis; and wherein the central ridge passes between the first set of heel cleat protrusions and the second set of heel cleats protrusions.

26. The sole assembly according to claim 21, wherein the sole assembly includes a forefoot plate embedded in the chassis, the forefoot plate having a posterior edge disposed in the midfoot region of the chassis.

27. The sole assembly according to claim 26, wherein the forefoot plate has an outer plate surface that fits with the lateral forefoot recess of the chassis and with the medial forefoot recess of the chassis; and wherein the forefoot plate has an inner plate surface that receives the lateral forefoot portion and the medial forefoot portion of the reinforcing member.

* * * * *